United States Patent [19]

Sloan et al.

[11] Patent Number: 4,598,740

[45] Date of Patent: Jul. 8, 1986

[54] HAND TOOL WITH VISUAL DISPLAY MEANS

[76] Inventors: Frederick Sloan, 10 Waterloo Park North, Belfast, BT 15; William Chambers, 41/42 Main Street, Groomsport, Co. Down, both of Northern Ireland

[21] Appl. No.: 488,238

[22] Filed: Apr. 25, 1983

[51] Int. Cl.[4] ..... B21F 3/00

[52] U.S. Cl. ..... 140/124; 29/720; 29/758; 242/7.17

[58] Field of Search ..... 140/123, 124; 73/862.23, 862.21; 72/37, 33, 32, 34; 29/720, 721, 758; 242/7.17, 7.18; 434/219, 224, 113

[56] References Cited

U.S. PATENT DOCUMENTS

| | | | |
|---|---|---|---|
| 3,142,943 | 8/1964 | Osborne | 434/219 |
| 3,479,720 | 11/1969 | Bohannon, Jr. et al. | 140/124 |
| 4,073,187 | 2/1978 | Avdeef | 73/862.21 |
| 4,257,263 | 3/1981 | Herrgen | 73/862.23 |

FOREIGN PATENT DOCUMENTS

| | | |
|---|---|---|
| 439863 | 3/1934 | United Kingdom . |
| 1022125 | 3/1966 | United Kingdom . |
| 1090383 | 11/1967 | United Kingdom . |

*Primary Examiner*—Francis S. Husar
*Assistant Examiner*—Linda McLaughlin

[57] ABSTRACT

A wire-wrap gun is provided with a visual display unit to assist the operator by displaying the addresses of the points which have to be electrically connected.

4 Claims, 1 Drawing Figure

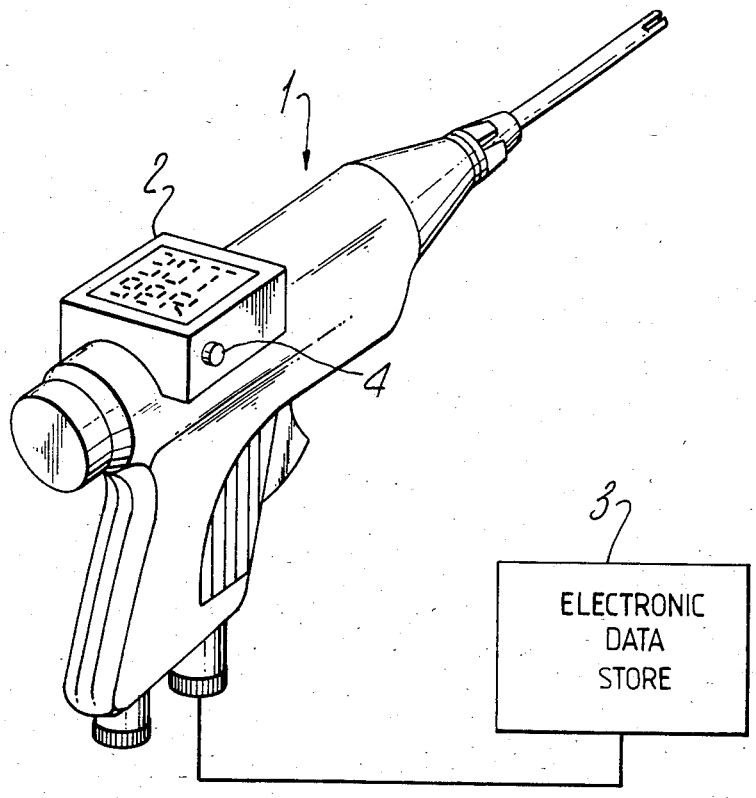
1
2
4
3
ELECTRONIC
DATA
STORE

HAND TOOL WITH VISUAL DISPLAY MEANS

BACKGROUND OF THE INVENTION

The present invention relates to improvements in hand tools and, more particularly, to a hand tool which enables the operator to utilize the tool more effectively.

The present invention is applicable to a variety of forms of tools but is particularly suited for use in tools used in connection with the electrical wiring up of sub-assemblies and modules for incorporation into telephone exchanges. It is known to use a hand-held so-called wire-wrap gun to electrically interconnect a large number of terminal pins by a large number of wires. Each such electrical connection is effected by the gun wrapping the end of a wire tightly round the respective terminal pin so that an electrical connection is made and held in place by friction.

Such wire-wrap guns are known per se and have been in extensive use for making electrical connections of the kind described. The use of such tools is disclosed in British Pat. Nos. 1,237,519 and 1,337,915, for example.

In the particular application referred to, i.e. the wiring up of telephone equipment, the operator of the wire-wrap gun is normally provided with a list of the electrical connections to be made, i.e. the "addresses" of the numerous interconnections, such a list usually taking the form of a large number of sheets of paper on which are lists of pin connections identified by a suitable matrix code of "addresses". The operator then interconnects the pins in accordance with these "addresses". Since the units being wired up can be of a substantial size, e.g. measure about 10 ft. long by 4 ft. high (they are usually set up substantially vertically for wiring up), it is clear that the operator will not be adjacent the written list of instructions for much of the time thus necessitating time consuming returns to the list in order to ascertain the next instruction or "address".

It is the object of the present invention to overcome the foregoing problem.

SUMMARY OF THE INVENTION

According to the present invention, a hand tool has a visual display incorporated therein which is adapted to be provided with data relevant to the function for which the tool is to be used to thereby assist an operator in the use of the tool.

The tool may be designed for any purpose and the display may take any form.

According to a particular aspect of the invention, the display comprises an electrically powered visual display unit and either includes an electronic data store from which data can be selected by the operator for display or is adapted to be connected to an electronic data store remote from the tool from which data can be selected by the operator for display.

According to a preferred aspect of the invention, the visual display unit comprises a light emitting diode (LED) display.

BRIEF DESCRIPTION OF THE DRAWING

The drawing illustrates in perspective view a wire-wrap gun incorporating the invention.

DESCRIPTION OF THE PREFERRED EMBODIMENT

The present invention overcomes the problem of having the wiring instructions at a remote location by providing on the wire-wrap gun itself, indicated by reference numeral 1 in the drawing, the necessary "address" at the point-of-work by means of a visual display unit 2. Such a display could take other forms but in the embodiment of the invention which is illustrated in the drawing the visual display comprises a so-called intelligent visual display which receives its information in a parallel form and consists of a light emitting diode (LED) display having four digits and seventeen segments; a typical example is the Litronix DL-2416. The LED could be of the DOT-matrix type which is smaller and neater than the above mentioned LED but it would have to be refreshed periodically by data fed to it, the data being received in a serial form. A typical DOT-matrix type display is the Hewlett Packard HDSP-2000.

The "addresses" of the pins which have to be wired together would be displayed by the LED, thus providing the operator with point-of-work information and making it unnecessary for the operator to move between the work and the instructions. In this way useful operating time is saved.

Where a large amount of information is involved in a particular job or task, the gun 1 would be electrically connected to an electronic data store 3 whereby the required information can be fed to the LED 2 by the operator activating an actuating member, e.g. a push-button 4.

Although the invention has been described with reference to its application to a wire-wrap gun for use in making electrical connections, it could be employed in any situation where a hand tool is being used by an operator who requires information fed to him periodically in order to enable him to carry out the assigned task.

What is claimed is:

1. A hand tool having electrically powered display means thereon, and electronic data store means providing said display means with instruction data relevant to the function for which the tool is to be used to thereby assist an operator in the use of the tool.

2. A hand tool as set forth in claim 1 wherein said display means comprises a visual display unit, and said electronic data store means is integral with the tool.

3. A hand tool as set forth in claim 2 in which said visual display unit comprises a light emitting diode (LED) display.

4. A wire-wrap gun hand tool incorporating an electrically powered visual display unit which includes an electronic data store means that supplies said display unit with the addresses of points which are to be electrically connected by the tool.

* * * * *